US009459006B2

(12) United States Patent
Bauver, II et al.

(10) Patent No.: US 9,459,006 B2
(45) Date of Patent: Oct. 4, 2016

(54) RADIAL NOZZLE ASSEMBLY FOR A PRESSURE VESSEL

(75) Inventors: Wesley P. Bauver, II, Granville, MA (US); Edward M. Ortman, Winsted, CT (US); Thomas W. Sambor, Granby, MA (US); Ian J. Perrin, North Granby, CT (US)

(73) Assignee: ALSTOM TECHNOLOGY LTD, Baden (CH)

( * ) Notice: Subject to any disclaimer, the term of this patent is extended or adjusted under 35 U.S.C. 154(b) by 0 days.

(21) Appl. No.: 13/477,168

(22) Filed: May 22, 2012

(65) Prior Publication Data

US 2013/0313341 A1 Nov. 28, 2013

(51) Int. Cl.

| | |
|---|---|
| ***A62C 31/02*** | (2006.01) |
| ***B05B 1/14*** | (2006.01) |
| ***F22B 37/22*** | (2006.01) |
| ***F22B 37/78*** | (2006.01) |

(52) U.S. Cl.

CPC ..... *F22B 37/225* (2013.01); *F22B 37/78* (2013.01)

(58) Field of Classification Search

CPC ..... F22B 37/78; F22B 37/225
USPC ..... 239/589, 553.3, 559, 590.3
See application file for complete search history.

(56) References Cited

U.S. PATENT DOCUMENTS

| | | | | |
|---|---|---|---|---|
| 349,509 | A * | 9/1886 | McCaffrey | 73/333 |
| 650,065 | A * | 5/1900 | Kitson | 73/333 |
| 755,456 | A * | 3/1904 | Coger | 73/333 |
| 796,249 | A * | 8/1905 | Rohan | 73/297 |
| 1,307,225 | A * | 6/1919 | West | 73/332 |
| 1,484,017 | A * | 2/1924 | Flueso | 122/234 |
| 1,595,021 | A * | 8/1926 | Plunkett | 73/332 |
| 1,605,226 | A * | 11/1926 | Fricke, Jr. et al. | 73/328 |
| 1,680,174 | A * | 8/1928 | Rhodes et al. | 73/333 |
| 2,153,213 | A | 4/1939 | Thomas et al. | |
| 2,203,357 | A * | 6/1940 | Kerr | 122/365 |
| 2,388,177 | A * | 10/1945 | Patterson et al. | 122/365 |
| 2,570,021 | A * | 10/1951 | Beach | 134/199 |
| 2,574,747 | A * | 11/1951 | McNutt | 239/338 |
| 2,726,896 | A * | 12/1955 | McKinnon | 239/335 |
| 2,897,554 | A * | 8/1959 | Myrick | 422/305 |
| 3,088,675 | A * | 5/1963 | Bone | 239/20 |
| 3,224,681 | A * | 12/1965 | Fiser et al. | 239/265.15 |
| 3,938,347 | A | 2/1976 | Riedel et al. | |
| 4,168,071 | A * | 9/1979 | Jacobson et al. | 277/606 |
| 4,336,825 | A * | 6/1982 | Pion | 137/403 |
| 4,471,627 | A * | 9/1984 | Hongo et al. | 62/49.2 |
| 4,490,984 | A * | 1/1985 | Hongo et al. | 62/49.2 |

(Continued)

FOREIGN PATENT DOCUMENTS

| | | |
|---|---|---|
| GB | 289733 | 5/1928 |

*Primary Examiner* — Len Tran
*Assistant Examiner* — Steven M Cernoch
(74) *Attorney, Agent, or Firm* — GE Global Patent Operation; Stephen G. Midgley

(57) ABSTRACT

A radial nozzle assembly for use in a pressure vessel to enable fluid flow through the vessel wall is provided. The radial nozzle assembly has a nozzle and a cup-shaped flange extending from one end of the nozzle. The nozzle has a bore disposed therethrough along its length to permit fluid flow through the wall of the pressure vessel. The flange is defined by a generally cup or dome-shaped wall having an open end. The nozzle assembly is secured to the wall of the vessel such that the nozzle is disposed in a radial orientation to the flange and possibly in a horizontal orientation.

22 Claims, 5 Drawing Sheets

(56) References Cited

U.S. PATENT DOCUMENTS

| | | | | |
|---|---|---|---|---|
| 4,506,512 | A * | 3/1985 | Delacour et al. | 62/49.2 |
| 4,531,479 | A * | 7/1985 | Gilbert | 122/504.2 |
| 4,679,529 | A | 7/1987 | Mancel | |
| 4,844,274 | A | 7/1989 | Sterk | |
| 6,932,028 | B1 | 8/2005 | Hatfield et al. | |
| 2004/0050959 | A1 * | 3/2004 | Mazooji et al. | 239/263.1 |
| 2004/0217197 | A1 * | 11/2004 | Mazooji et al. | 239/302 |
| 2007/0221144 | A1 * | 9/2007 | Becker et al. | 122/511 |

* cited by examiner

RADIAL NOZZLE ASSEMBLY FOR A PRESSURE VESSEL

FIELD OF THE INVENTION

The present invention is generally related to nozzles for use in pressure vessels and is more particularly directed to a radial nozzle assembly having a nozzle that extends radially and horizontally from a cup-shaped flange disposed at one end of the nozzle.

BACKGROUND

Pressure vessels are typically subjected to cyclic thermal and mechanical stresses due to changes in internal fluid pressure and temperature. These cyclic stresses can limit the number and/or magnitude of pressure and/or temperature cycles that the pressure vessels can withstand. Historically, pressure vessels have bores, or penetrations extending through the shell of the pressure vessel. Conduits such as pipes are attached to the pressure vessel such that the penetration and the pipes are in fluid communication with one another to allow for the ingress and egress of fluids to and from the pressure vessel. Stress concentrations exist at the intersection of the pipe(s) and the shell of the pressure vessel. These stress concentrations result in higher stresses and often become a limiting factor in the design of the pressure vessel for phenomena such as fatigue and/or cracking of the magnetite layer that can form on the metal surface, and which may limit the useful lifetime.

Such a pressure vessel may be a boiler or steam drum of an evaporator system as shown in FIG. 1. Referring to FIG. 1, an exemplary prior art evaporator system 100 of a heat recovery steam generator is depicted that comprises an evaporator 102 and a steam drum 104. The steam drum 104 is in fluid communication with the evaporator 102. In a natural circulation heat recovery steam generator, either no flow or minimal flow is established until boiling begins in the evaporator 102. This generally results in a very rapid rise in the steam drum 104 temperature.

For example, for a cold start the water temperature inside the steam drum 104 can rise from 15° C. to 100° C. in less than 10 minutes. This produces a large thermal gradient and hence compressive stress in the steam drum 104 wall. As the pressure in the steam drum 104 increases, the temperature gradient through the drum wall is reduced and consequently the stress due to pressure becomes the dominant stress in the drum. The stress due to pressure (with increased pressure in the steam drum 104) is a tensile stress. The stress range for the drum is determined by the difference between the final tensile stress at full load (pressure) and the initial compressive thermal stress. Boiler Design Codes (such as ASME and EN) impose limits on the stress at design pressure. Some codes, such as for example EN12952-3, also include limits on the permissible stress range for a startup-shutdown cycle. These limits are intended to protect against fatigue damage and phenomena such as cracking of the magnetite layer that forms on the surface of the steel at operating temperature.

Furthermore, steam boilers are provided with a means of determining the water level in the steam drum, as shown in FIG. 2. Water level is typically measured by means of a sight glass and/or pressure transducers 106, which are connected to the drum 104 by an upper and lower connecting tube (nozzle) 108. Boiler Design Code EN 12952-7:2002(E) Section 5.4.2 states "The connecting tubes between the steam boiler and the local water level indicators shall have an inside diameter of at least 20 mm. If the water level indicators are connected by means of common connecting lines or if the water side connecting tubes are longer than 750 mm, the latter shall have an inside diameter of at least 40 mm. Connecting tubes on the steam side shall be designed so that condensate does not accumulate. Water-side connection tubes shall always be arranged horizontally to the water level indicators." This requirement means that the connecting tubes 108 would typically penetrate the boiler drum non-radially as shown in FIG. 2. The non-radial arrangement results in a high stress concentration as shown in FIG. 3.

Referring to FIG. 3, the results of a finite element analysis, in the form of a stress contour plot of a cut-away view of a portion of a nozzle assembly 109, are shown. The stress contour plot depicts areas of varying stress, the stress contours being superimposed over a section of a known prior art nozzle assembly. The nozzle assembly 109 includes a nozzle that extends through an aperture to an interior area defined by a pressure vessel wall 104. In the illustrated embodiment the area of maximum local stress is located at the intersection at 110 defined between the nozzle 109 and an interior surface of the pressure vessel wall. In general, the nozzle 109 is attached to the pressure vessel 104 via welding. This stress concentration can result in a stress range of greater than 600 megapascals (MPa) in the high pressure drums at 110 during cold startups of Heat Recovery Steam Generators (HRSG), for example, that operate in the range of 150 bar or higher. EN 12952-3 section 13.4.3 requires that the stress range be less than 600 MPa to avoid magnetite cracking. The combination of these requirements make it difficult for HRSG high pressure drums with standard connecting tube arrangements to meet the requirements of the EN Boiler Design Code.

A new approach is suggested by the present invention in which a radial nozzle assembly is used in place of the horizontal connecting nozzle, the radial nozzle assembly being large enough so that a continuous horizontal path is maintained from the inside of the drum to a sensing line 242 as shown in FIG. 5. This configuration results in reduced stress concentrations and lowers the stress range to below 600 MPa as shown in FIG. 7.

SUMMARY

In one embodiment of the present invention, a nozzle assembly for use in a pressure vessel is provided. The pressure vessel is defined by a wall having an inner surface of which defines an interior area. An aperture extends through the wall of the pressure vessel. The nozzle assembly includes a nozzle having an inner and outer end with a bore disposed therein along its length to provide for fluid flow therethrough. The nozzle assembly includes a flange that extends from the inner end of the nozzle. The flange is defined by a wall having a cup-shape with an open end which defines an interior area. The open end of the flange is attachable to the pressure vessel in fluid communication with the aperture of the wall of the pressure vessel.

DETAILED DESCRIPTION

Figure 1:
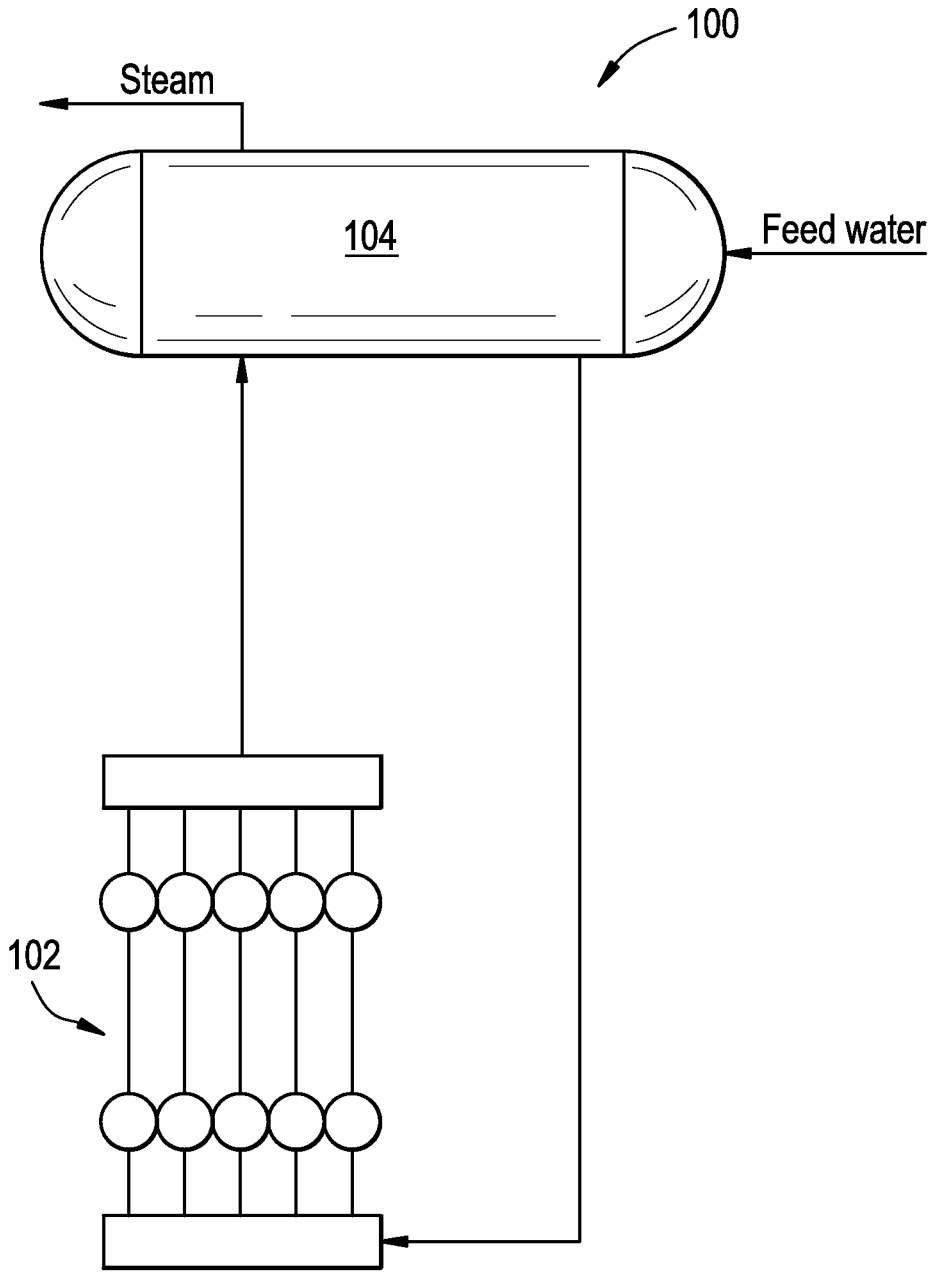
FIG. 1 Prior Art
FIG. 1 is a schematic view of an evaporator system in accordance with the prior art.
Figure 2:
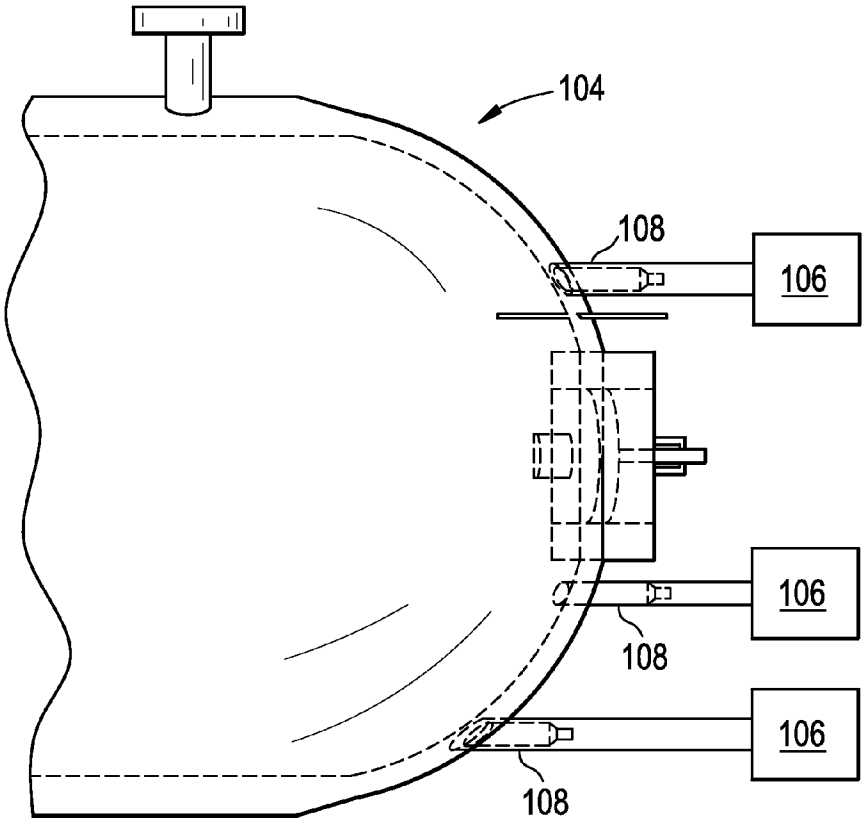
FIG. 2 Prior Art
FIG. 2 is cross-sectional view of a portion of a pressure vessel showing a plurality of non-radial, horizontal nozzle extending therefrom in accordance with the prior art.
Figure 4:
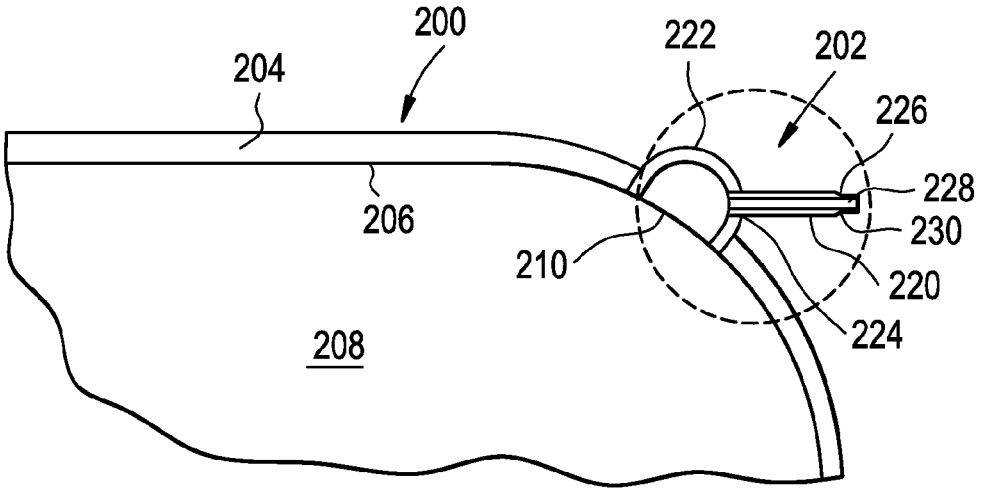
FIG. 4 is cross-sectional view of a portion of a pressure vessel showing a horizontal nozzle extending radially from the wall of the pressure vessel in accordance with the present invention.
Figure 5:
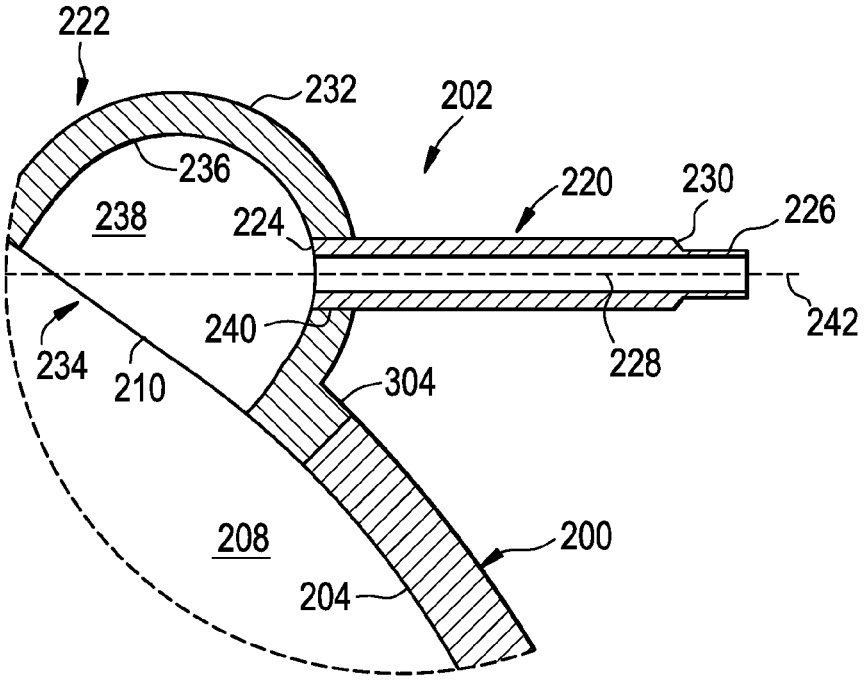
FIG. 5 is an expanded view, cross-sectional view of a portion of a pressure vessel showing a non-radial, horizontal nozzle of FIG. 4 extending radially from the wall of the pressure vessel.

FIGS. 4 and 5 illustrate an upper portion of a pressure vessel 200 having disposed therein a radial nozzle assembly 202 in accordance with the present invention. The pressure vessel 200 includes a wall 204 having an interior surface 206 to define an interior area 208. The wall 204 of the pressure vessel 200 has a bore or aperture 210 passing therethrough to permit fluid to pass between the interior area 206 to the exterior of the pressure vessel 200. The nozzle assembly 202 is secured to the wall 204 of the pressure vessel 200 to provide a connection for fluidly transferring fluid from the interior area 208 of the vessel, through the nozzle assembly and to a pipe, tube or other device attached to the nozzle assembly 106 (as shown in FIG. 2).

The radial nozzle assembly 202 includes a nozzle 220 and a cup-shaped flange 222 for securing the nozzle assembly to the wall 204 of the pressure vessel 200 such that the nozzle is disposed in both a radial orientation to the flange and a horizontal orientation. The nozzle has an inner and outer end 224, 226, respectively, with a bore 228 disposed therethrough along its length to permit fluid flow through the wall 204 of the pressure vessel 200. Preferably, the bore is disposed axially along its length. The outer end 226 of the nozzle 220 has a circumferentially chamfered surface 230 to reduce the outer dimensions to accommodate the pipe, conduit or device 106 (as shown in FIG. 2) that may be attached or otherwise secured to the outer end of the nozzle. The flange 222 extends from the inner end 224 of the nozzle 220.

The flange 222 is defined by a generally cup or dome-shaped wall 232 having an open end 234. The flange wall 232 has an inner concave surface 236 that defines an interior area 238. In one embodiment, the inner end 224 of the nozzle 220 may be integrally formed in the flange 222 at a predetermined location and angle, which will be described in greater detail hereinafter. Alternatively, the nozzle 220 may be a separate piece secured to the flange 222. In such an embodiment, the flange wall 232 has a through-bore or aperture 240 at a predetermined location and angle. This location and angle of the bore 240 may be dependent on the dimensions of the flange 222 and the vessel 200, and the location of the nozzle assembly 202 on the vessel, which will be described in greater detail hereinafter. The inner end 224 of the nozzle 230 is secured within or about the bore 240 of the flange wall 232, such as by welding, to provide fluid communication from the outer end 226 of the nozzle to the interior area 238 of the flange 222. The nozzle 220 is secured to the flange 222 in one embodiment such that the nozzle is disposed radially to the curvature of the flange and horizontally when attached to the pressure vessel 200. The flange 222 may be spherical or hemispherical in shape having a predetermined radius.

Figure 6:
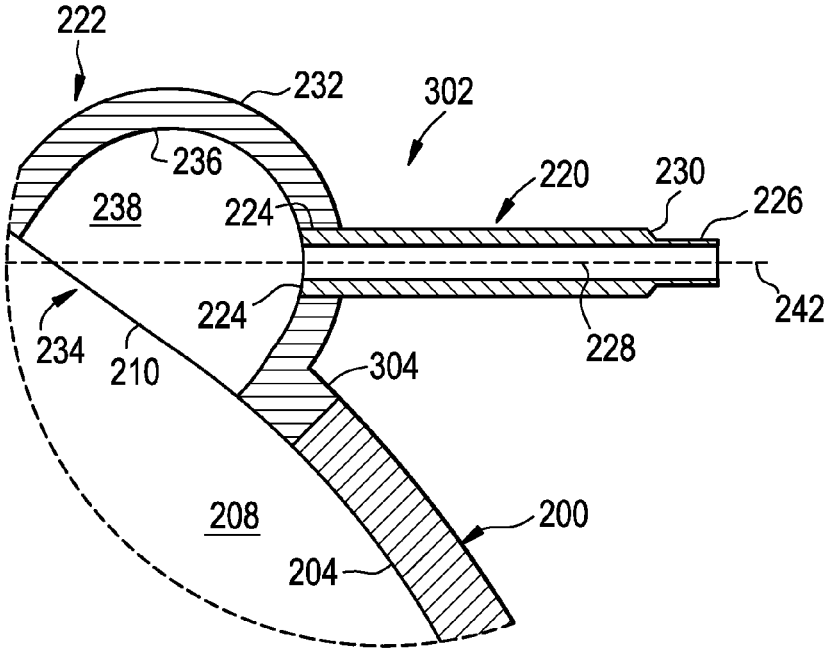
FIG. 6 is an expanded view, cross-sectional view of another embodiment of a portion of a pressure vessel showing a non-radial, horizontal nozzle of FIG. 4 extending radially from the wall of the pressure vessel

The open end 234 of the flange 222 is attached, such as by welding, in or about the bore 210 in the arcuate portion of the wall 204 of the pressure vessel 200, as best shown in FIGS. 5 and 6. As previously suggested, the nozzle assembly 202 is particularly useful for a steam drum of an evaporator system, wherein the steam drum 200 includes a number of horizontal nozzles for passing fluid from the inside the steam drum to a fluid level indicators or sensors. As required by Boiler Code, the water-side connection tubes (nozzles) 220 are arranged horizontally to the water level indicators. For specific applications, such as fluid level indicators, the wall of the vessel 200 and the flange 222 of the radial nozzle assembly 202 should not interfere with or affect the fluid flow passing through the nozzle 220 to determine the water level within the pressure vessel or steam drum 200. Consequently, the bore 228 of the nozzle 220 should have a direct, unblocked line of sight into the interior area 208 of the pressure vessel 200, as shown in FIGS. 5 and 6 as noted by dashed line 242. The features of the flange 222 (e.g., radius), the curvature of the vessel wall 204, and the thickness of the vessel wall are arranged to provide this unobstructed fluid communication between the interior area 208 of the vessel 200 and the bore 228 of the nozzle 220. Furthermore, the diameter or dimensions of the opening of the open end 234 of the flange 222 of the nozzle assembly 202 and the bore 240 of the flange wall 232 are sufficiently large to provide a continuous horizontal path 242 from the interior area 208 of the vessel 200, through the flange and through the bore 238 of the nozzle 220. This feature is important when the nozzle assembly 202 is used for and fluidly connected a fluid level indicator or sensor 106 (see FIG. 2), wherein the fluid within the vessel 200 passes through the nozzle assembly 202 to the fluid level indicator 106.

Referring to FIG. 6, a radial nozzle assembly 302 in accordance with the present invention is shown attached to a pressure vessel 200. The radial nozzle assembly 302 is similar to the radial nozzle assembly of FIG. 5. Accordingly like elements will be assigned same like reference numbers. The radial nozzle assembly further includes an outer flange 304 extending outwardly from the outer edge of the open end 234 of the flange 222. The curvature of the outer flange is shaped to match the shape of the wall 204 of the vessel 200 about the bore 210 of the vessel wall 204. The nozzle assembly 302 is disposed with the bore 210 of the vessel wall 204 and attached to the vessel wall 204, such as by welding, about the outer edge of the outer flange 304 to reduce the stress at the point of the weld or attachment.

Figure 3:
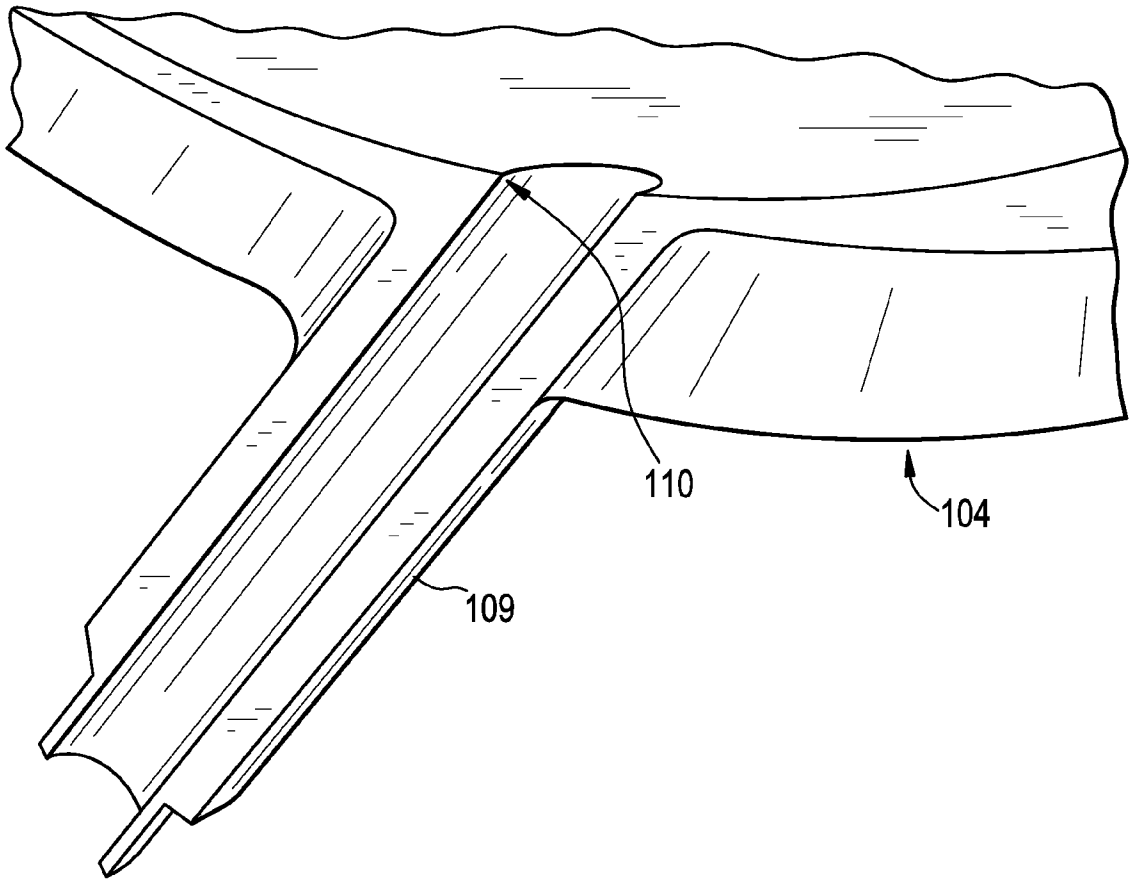
FIG. 3 Prior Art
FIG. 3 is a finite element analysis stress contour plot showing a prior art nozzle installed in a pressure vessel subjected to cyclic temperature and pressure loads typically found in a boiler drum used in a heat recovery steam generator.
Figure 7:
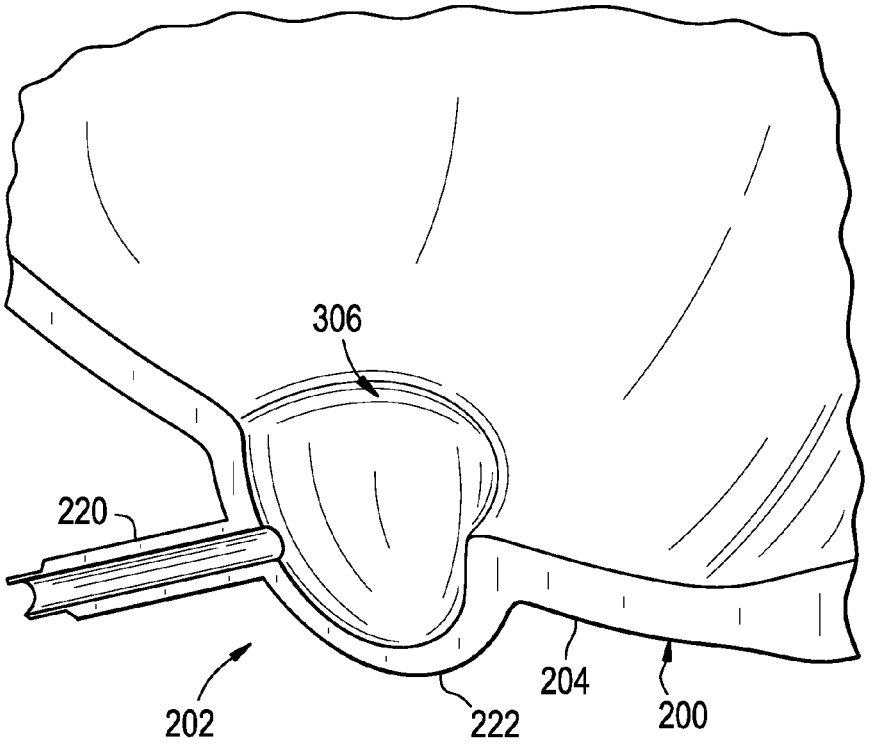
FIG. 7 is a finite element analysis stress contour plot showing an embodiment of a nozzle as described herein installed in a pressure vessel in accordance with the present invention subjected to cyclic temperature and pressure loads typically found in a boiler drum used in a heat recovery steam generator.

Referring to FIG. 7, the finite element or other stress analysis illustrates the stresses due to temperature and pressure at the intersection of the radial nozzle assembly 202 and the inner surface of the pressure vessel wall 204. In the illustrated embodiment the local stress range at the intersection at 306 provides a reduced peak stress range than the prior art shown in FIG. 3, wherein the reduced stress range is well below 600 MPa for a cold start.

The present invention provides an option for natural circulation for heat recovery steam generators instead of once through applications for high pressure applications.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A nozzle assembly for use in a pressure vessel defined by a vessel wall having an inner surface of which defines an interior area and an aperture that extends through an arcuate portion of the vessel wall, the nozzle assembly comprising:

a nozzle having an inner and outer end with a bore disposed therein along its length to provide for fluid flow therethrough; and a flange extending from the inner end of the nozzle, the flange being defined by a rounded wall having a generally dome-like shape with a concave inner surface and an open end;

wherein the nozzle extends radially relative to both a vertical curvature and horizontal curvature of the rounded wall of the flange from an exterior of the rounded wall of the flange at a connection portion of the exterior that is curved at the entire interface of the nozzle and the exterior;

wherein the open end of the flange is attachable to the arcuate portion of the vessel wall to provide fluid communication between the nozzle and the interior area of the pressure vessel through the aperture of the arcuate portion of the vessel wall;

wherein the curvature of the arcuate portion of the vessel wall is different than the curvature of the rounded wall of the flange; and wherein the arcuate portion of the vessel wall and the flange provides a clear direct, unblocked line of sight path from the interior area of the pressure vessel, through the flange and through the bore of the nozzle.

2. The nozzle assembly of claim 1, wherein the nozzle extends substantially horizontally.

3. The nozzle assembly of claim 1, wherein the nozzle extends radially from the arcuate portion of the vessel wall.

4. The nozzle assembly of claim 1, wherein the flange is spherical in shape.

5. The nozzle assembly of claim 1, wherein the flange is hemispherical in shape.

6. The nozzle assembly of claim 1, wherein the stress range at the intersection of the wall of the vessel and the flange of the nozzle is less than 600 MP for a cold start.

7. The nozzle assembly of claim 1, further comprising a level indicator in fluid communication with the outer end of the nozzle.

8. The nozzle assembly of claim 1, wherein the flange includes a second flange disposed about an outer edge of the open end of the flange for securing the nozzle assembly to the arcuate portion of the vessel wall, wherein the second flange has a curvature matching the curvature of the arcuate portion of the vessel wall about the aperture therein.

9. The nozzle assembly of claim 1, wherein the flange is attached to the arcuate portion of the vessel wall via at least one weld.

10. The nozzle assembly of claim 1, wherein the flange is integral to the arcuate portion of the vessel wall.

11. The nozzle assembly of claim 1, wherein the nozzle is attached to the flange via at least one weld.

12. The nozzle assembly of claim 1, wherein the nozzle is integral to the wall of the flange.

13. A pressure vessel comprising:

a vessel wall having an arcuate portion, an inner surface of which defines an interior area and an aperture that extends through the arcuate portion of the vessel wall; and a nozzle assembly including:

a nozzle having an inner and outer end with a bore disposed therein along its length to provide for fluid flow therethrough; and a flange extending from the inner end of the nozzle, the flange being defined by a rounded wall having a generally dome-like shape with a concave inner surface and an open end;

wherein the nozzle extends radially relative to both a vertical curvature and horizontal curvature of the rounded wall of the flange from an exterior of the rounded wall of the flange at a connection portion of the exterior that is curved at the entire interface of the nozzle and the exterior;

wherein the open end of the flange engages the arcuate portion of the vessel wall to provide fluid communication between the nozzle and the interior area of the pressure vessel through the aperture of the arcuate portion of the vessel wall; and wherein the curvature of the arcuate portion of the vessel wall is different than the curvature of the rounded wall of the flange; and wherein the arcuate portion of the vessel wall and the flange provide a clear direct, unblocked line of sight path from the interior area of the pressure vessel, through the flange and through the bore of the nozzle.

14. The pressure vessel of claim 13, wherein the nozzle extends substantially horizontal.

15. The pressure vessel of claim 13, wherein the flange is spherical in shape.

16. The pressure vessel of claim 13, wherein the flange is hemispherical in shape.

17. The pressure vessel of claim 13, wherein the stress range at the intersection of the rounded wall of the pressure vessel and the flange of the nozzle is less than 600 MPa when a heated fluid is initially provided to the pressure vessel.

18. The pressure vessel of claim 13, further comprising a level indicator is in fluid communication with the outer end of the nozzle.

19. The pressure vessel of claim 13, wherein the flange includes a second flange disposed about an outer edge of the open end of the flange for securing the nozzle assembly to the rounded wall of the arcuate portion of the vessel wall, wherein the second flange has a curvature matching the curvature of the arcuate portion of the vessel wall about the aperture therein.

20. The pressure vessel of claim 13, further comprising a second nozzle assembly provided at a different vertical location on arcuate portion of the vessel wall than the first nozzle assembly, wherein the second nozzle assembly is similar to the first nozzle assembly.

21. The pressure vessel of claim 13, wherein the nozzle extends from the arcuate portion of the vessel disposed between a top portion and a bottom portion of the pressure vessel.

22. A pressure vessel comprising:

a vessel wall having an arcuate portion, an inner surface of which defines an interior area and an aperture that extends through the arcuate portion of the vessel wall; and a nozzle assembly including:

a nozzle having an inner and outer end with a bore disposed therein along its length to provide for fluid flow therethrough, wherein the nozzle extends substantially horizontal; and a flange extending from the inner end of the nozzle, the flange being defined by a rounded wall having a generally dome-like shaped with a concave inner surface and an open end;

wherein the nozzle extends radially relative to both a vertical curvature and horizontal curvature of the rounded wall of the flange from the rounded wall of the flange;

wherein the open end of the flange engages the arcuate portion of the vessel wall to provide fluid communication between the nozzle and the interior area of the pressure vessel through the aperture of the arcuate portion of the vessel wall;

wherein the arcuate portion of the vessel wall and the flange provide a clear direct, unblocked horizontal line of sight path from the interior area of the pressure vessel, through the flange and through the bore of the nozzle; and wherein the curvature of the arcuate portion of the vessel wall is different than the curvature of the rounded wall of the flange.

* * * * *